US007194104B2

(12) United States Patent
Sahyoun

(10) Patent No.: US 7,194,104 B2
(45) Date of Patent: Mar. 20, 2007

(54) UNIVERSAL AUDIO SPEAKER CONNECTION BLOCK

(76) Inventor: Joseph Y. Sahyoun, 3031 Hopkins Ave., Redwood City, CA (US) 94062

( * ) Notice: Subject to any disclaimer, the term of this patent is extended or adjusted under 35 U.S.C. 154(b) by 499 days.

(21) Appl. No.: 10/797,208

(22) Filed: Mar. 9, 2004

(65) Prior Publication Data

US 2004/0196987 A1 Oct. 7, 2004

Related U.S. Application Data

(60) Provisional application No. 60/453,811, filed on Mar. 10, 2003.

(51) Int. Cl.
*H04R 25/00* (2006.01)

(52) U.S. Cl. ..... 381/401; 381/409; 381/410

(58) Field of Classification Search ..... 381/89, 381/300, 332, 335, 400, 401, 402, 182, 186, 381/111, 117, 409, 410; 336/180–182; 29/594, 29/605, 606, 609.1
See application file for complete search history.

(56) References Cited

U.S. PATENT DOCUMENTS 3,686,446 A * 8/1972 Manger ..... 381/117
4,473,811 A * 9/1984 Schauble ..... 336/171
5,937,076 A * 8/1999 Tanabe et al. ..... 381/409

* cited by examiner

*Primary Examiner*—Huyen Le
(74) *Attorney, Agent, or Firm*—Allston L. Jones

(57) ABSTRACT

A speaker interconnection block with two voice coils to be driven with separate amplifiers, or to use one amplifier to drive the two voice coils in series or parallel without having to reinterconnect the voice coils. This is achieved by locating the negative voice coil terminals next to each other and the positive voice terminals next to each other on the connection block. When two amplifiers are used to drive the voice coils, the sequence of connections of the amplifiers matches those of the voice coils mentioned above. When only one amplifier is used, that amplifier is connected between the two amplifier terminals farthest from each other. To connect the voice coils in series a single jumper is used to interconnect the two terminals in the center, and for parallel connection two jumpers are used to connect to two terminals at the ends of the sequence together separately.

31 Claims, 8 Drawing Sheets

UNIVERSAL AUDIO SPEAKER CONNECTION BLOCK

CROSS-REFERENCE

The present application claims priority from U.S. Provisional Application having Ser. No. 60/453,811 filed Mar. 10, 2003.

BACKGROUND OF THE INVENTION

1. Field of the Invention

The present invention relates to connection terminals that are attached to an audio speaker frame for connecting the speaker to a signal source such as an amplifier. More particularly the present invention relates to a universal audio speaker connection block that provides a fool-proof way to connect one or two amplifiers to a speaker having two voice coils, and connecting one amplifier to the two voice coils either in parallel or series.

2. Description of the Prior Art

Increasingly, multi-channel amplifiers or multiple smaller amplifiers have been used in audio systems, typically when larger amplifiers are not available or would be inconvenient in a particular application. When multi-channel or multiple amplifiers are used, the speakers for such a system must have the same number of voice coils wound on the same bobbin as there are channels or amplifiers. Additionally, manufactures are producing speakers with two voice coil windings on the same bobbin to allow for the interconnection of those coils either in series or in parallel to match the output impedance of the amplifier being used in the audio system.

For years manufacturers of speakers with a single voice coil have designed the speaker such that both ends of the voice coil were dressed to one side of the speaker frame where they had provided a connection block with a pair of terminals, one each for the positive and negative sides of the voice coil. Then as manufactures started making speakers with two voice coils, the ends of each of the voice coils were dressed to opposite sides of the speaker with a typical connection block provided on each side of the speaker with a channel from the amplifier or amplifiers connected to each of the connection blocks. One manufacturer has recently begun to dress both pair of voice coil wires to the same side with two typical connection blocks located close to the other.

With the terminal blocks of the prior art many users have been confused as to how to interconnect the terminals to place the voice coils in series or parallel across a single amplifier. Their confusion often results in the two voice coils being connected out of phase with each other resulting in the magnetic signals from each voice coil being in opposition to each other and there being no substantial movement of the voice coil bobbin and thus no audio output from the speaker.

What is needed is a connection block for dual voice coil speakers that accommodates every configuration of amplifier and voice coil interconnections that may be desired in various audio systems while minimizing the possibility of misconnections. The present invention provides such a speaker connection block.

SUMMARY OF THE INVENTION

The present invention provides a nearly fool proof speaker interconnection block that allows the user to drive a speaker with two voice coils with separate amplifiers, or to use one amplifier to drive the voice coils connected in either series when a higher speaker impedance is desired or in parallel when a lower speaker impedance is desired.

This is achieved by arranging the voice coil connection points in the universal speaker connection block of the present invention such that the two negative voice coil terminals are next to each other and the two positive voice terminals are next to each other with the sequence alternating 1−, 2−, 1+, 2+; or 2−, 1−, 2+, 1+; or 1+, 2+, 1−, 2−; or 2+, 1+, 2−, 1−; from either the right or left side of the connection block. Additionally, when two amplifiers are used to drive the voice coils, the sequence of connections of the amplifiers matches that of the connections of the voice coils mentioned above. When only one amplifier is used, that amplifier is connected to correspond with the sign of the left and right ends of the voice coil connection sequence that is being used. To connect the voice coils in series, a single jumper is used to interconnect the two terminals in the center of the sequence, and for parallel connection two jumpers are used to connect the two terminals at each end of the sequence together separately.

DESCRIPTION OF THE PREFERRED EMBODIMENT

Figure 1:
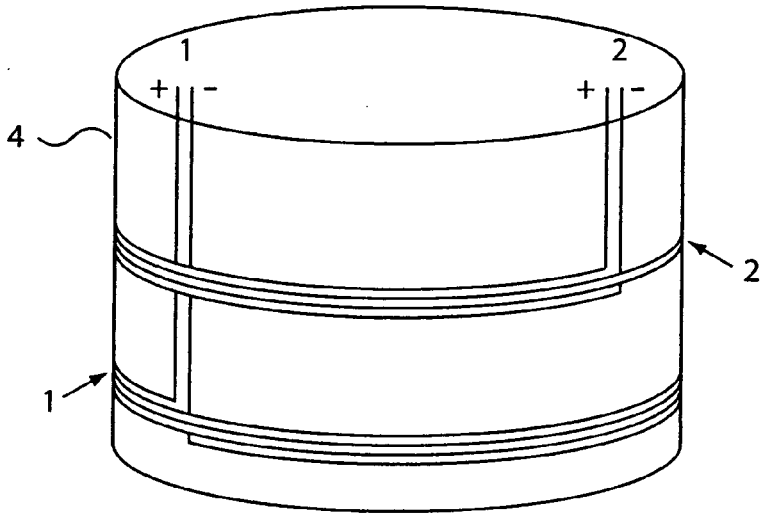
FIG. 1 (PRIOR ART)
FIG. 1 is a perspective view of a prior art voice coil bobbin having two separate voice coils wound thereon.

FIG. 1 is a perspective view of a typical voice coil bobbin 4 having two separate voice coils 1, 2 wound thereon with the leads extending from the top of each coil being designated positive and the lead extending from the bottom of each coil being designated negative.

Figure 2:
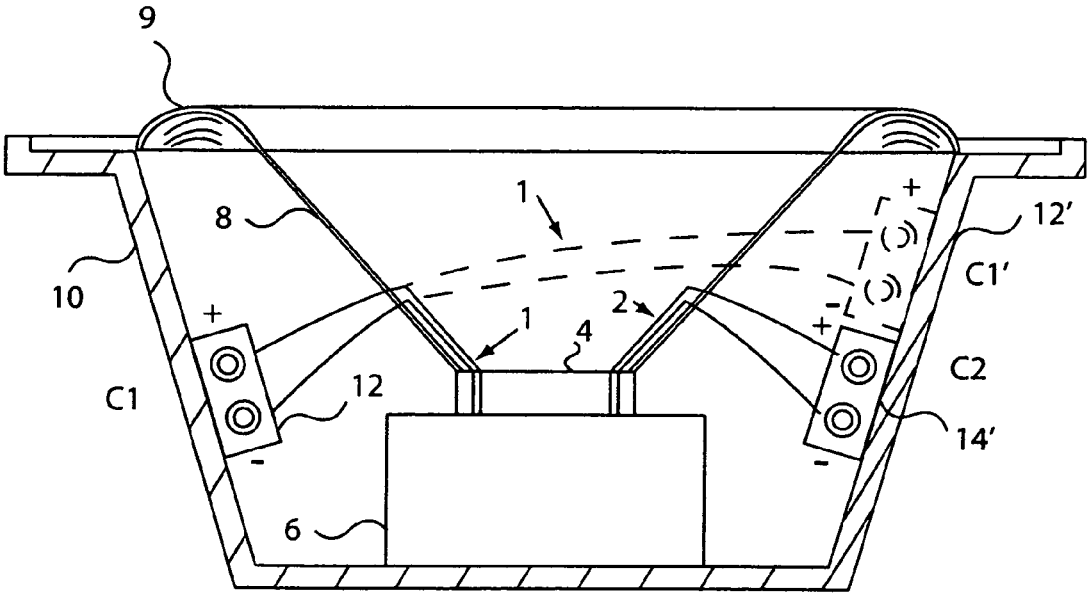
FIG. 2 (PRIOR ART)
FIG. 2 is vertically cross-sectioned view of a typical speaker having two voice coils with the voice coil wire pair connection blocks either on opposite sides of the speaker basket or on the same side of the speaker basket.

FIG. 2 is a vertically cross-sectional view of a typical speaker having bobbin 4 with two voice coils in place in magnet 6. The upper end of bobbin 4 is attached to the center of speaker cone 8, and in turn cone 8 is connected to surround 9 which in turn is mounted at the mouth of speaker basket 10. The leads of voice coil 1 are shown dressed up to the left into, and through, cone 8 to two terminal connection block 12 (C1) on the left side with the corresponding terminals labeled + and –, respectively. Similarly, the leads of voice coil 2 are shown dressed up to the right into, and through, cone 8 to two terminal connection block 14 (C2) on the right side with the corresponding terminals labeled + and –, respectively. Alternatively, the leads of voice coil 1 (broken lines) could be dressed up and to the right into, and through, cone 8 to two terminal connection block 12' (C1') on the right side with the corresponding terminals labeled + and –, respectively. In both cases, the connection blocks C1 and C2 are independent of each other.

Figure 3:
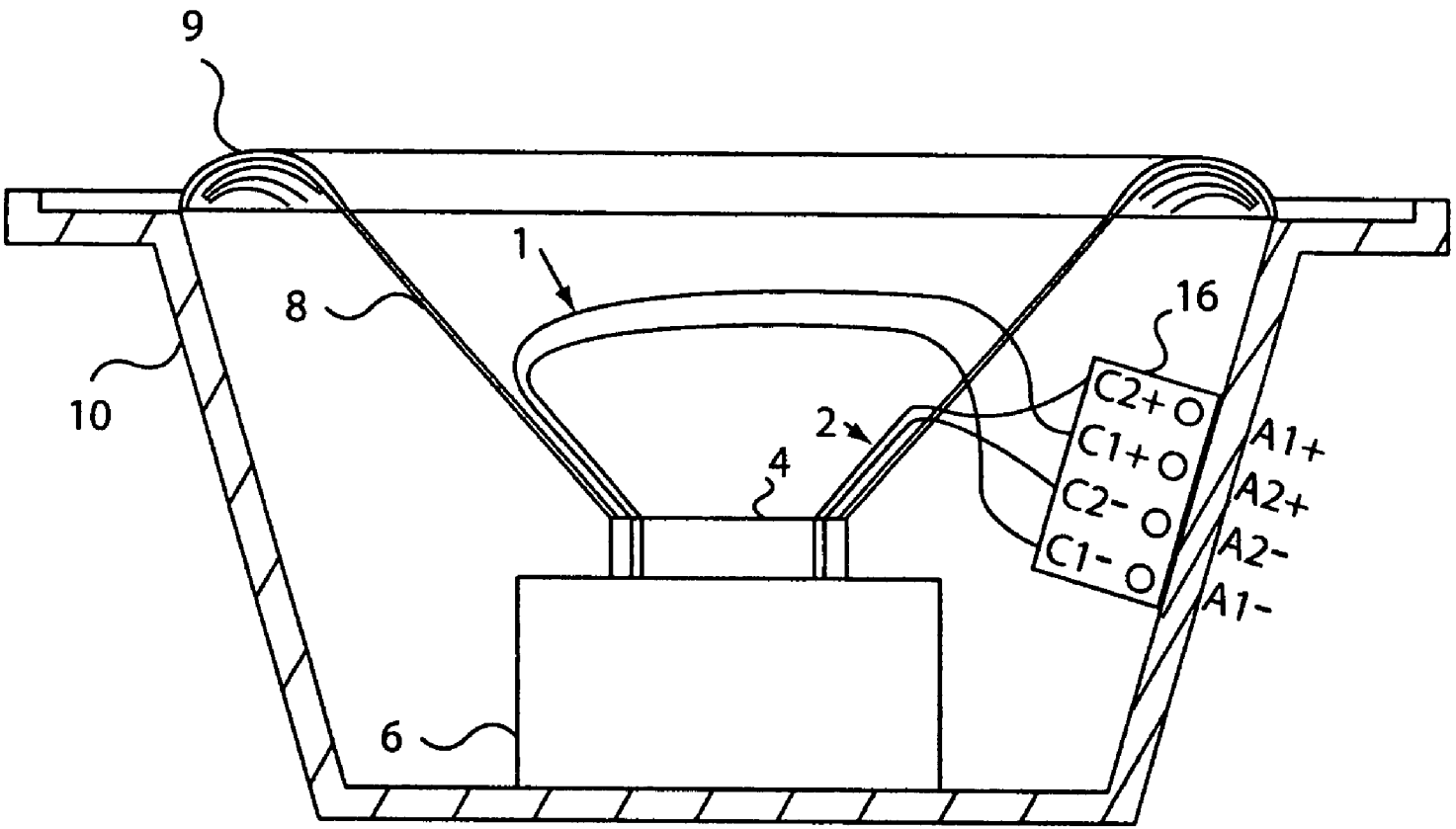
FIG. 3 is vertically cross-sectioned view of a typical speaker having the universal connection block of the present invention.

FIG. 3 is vertically cross-sectioned view of a typical speaker having the universal connection block of the present invention on the right side. In this embodiment both pair of voice coil leads are dressed to the right and through cone 8 and connected to universal speaker connection block 16 of the present invention. The + and – leads from voice coil 1 are attached to terminals C1+ and C1–, respectively, and the + and – leads from voice coil 2 are attached to terminals C2+ and C2–, respectively, of universal connection block 16. Also provided on connection block 16 are + and – terminals to be connected to amplifiers A1 and A2 (not shown).

Figure 4A:
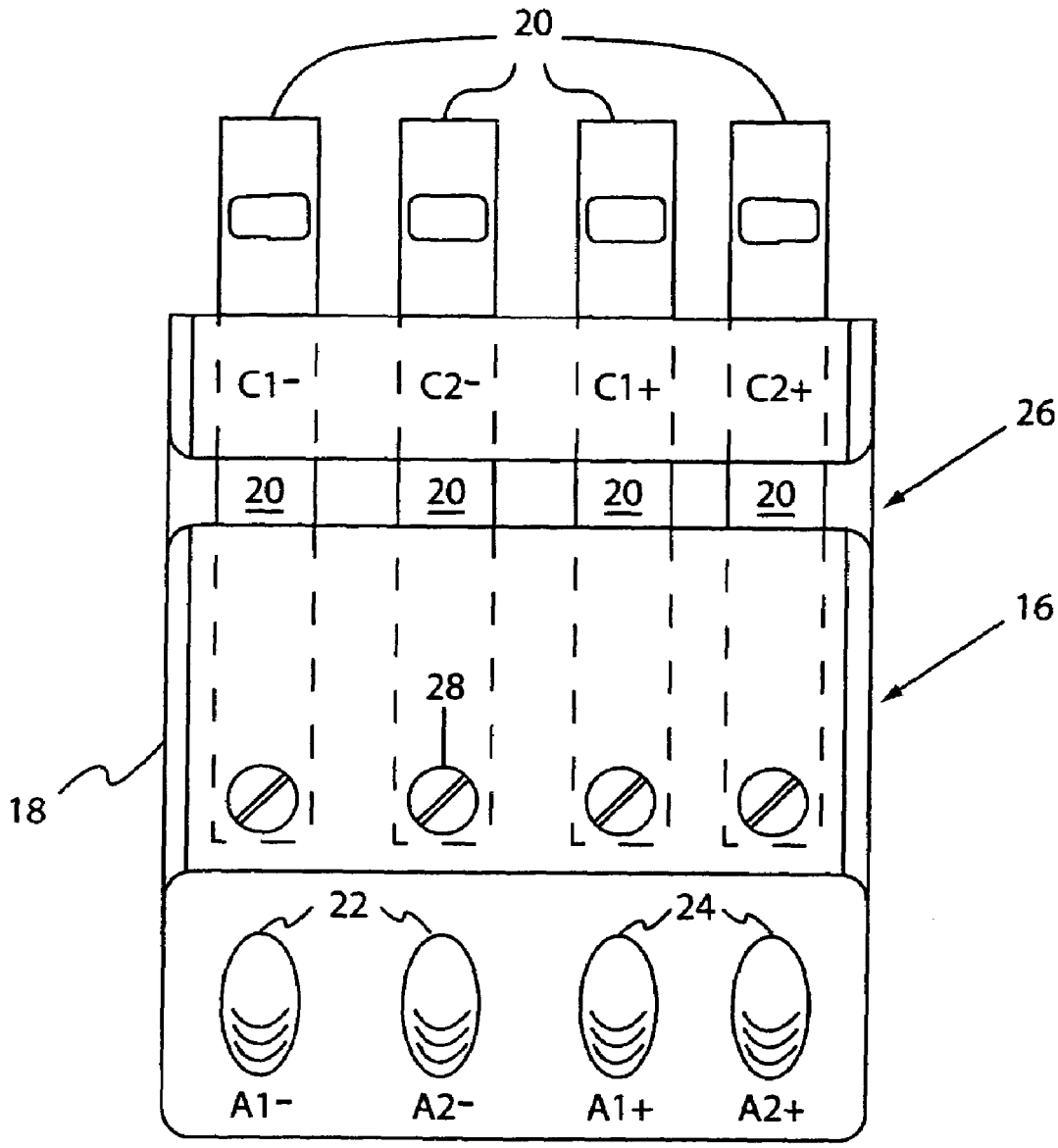
FIG. 4A is a plan view of one embodiment of the universal connection block of the present invention.
Figure 4B:
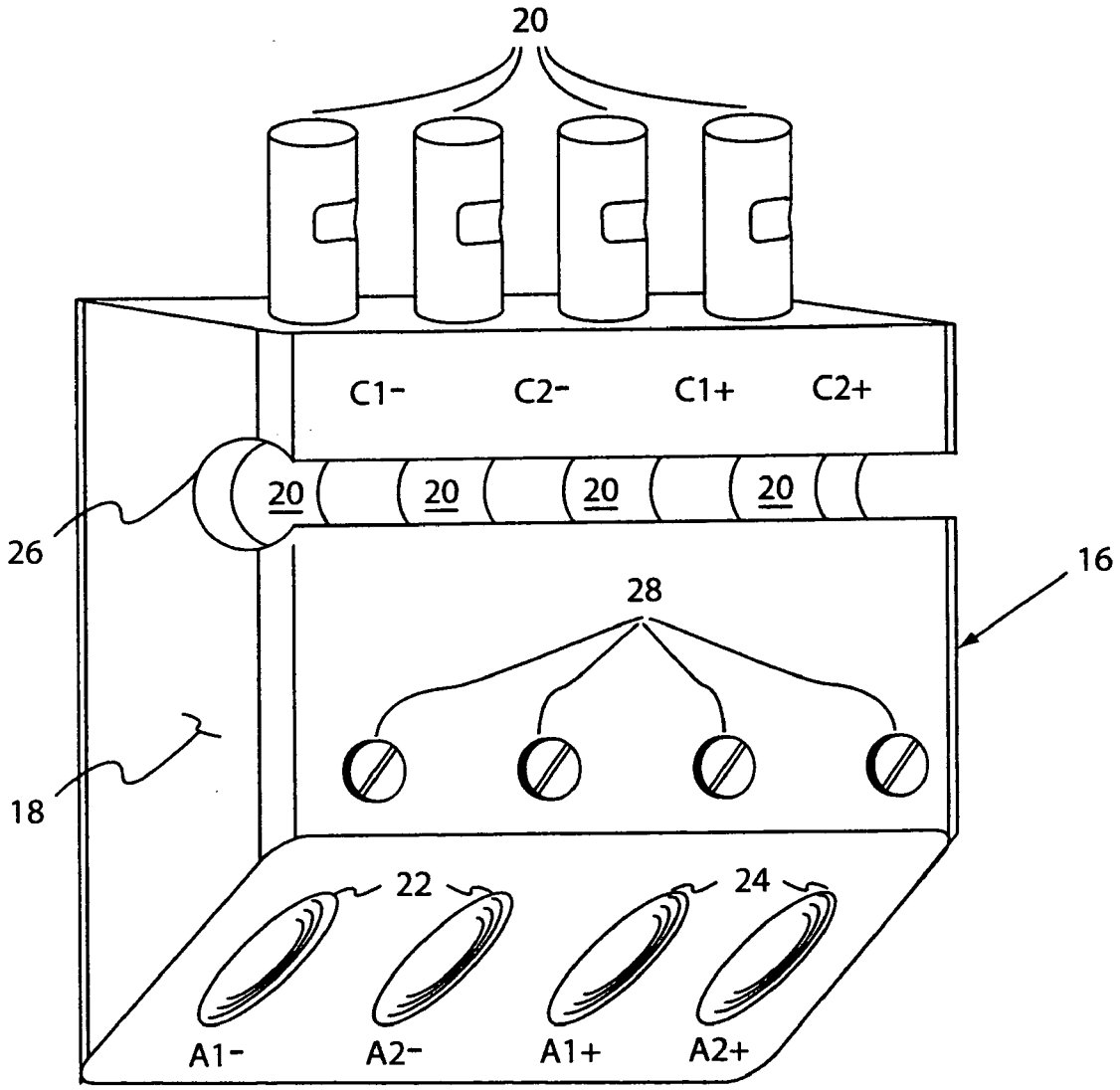
FIG. 4B is a perspective view of the universal connection block as in FIG. 4A.

FIGS. 4A and 4B are a plan view and a perspective view, respectively, of an embodiment of universal connection block 16 of the present invention. Included are a body 18 of an electrically non-conductive material that defines four longitudinal channels therethrough that have electrically conductive rods or tubes 20 inserted thereinto. As shown in FIGS. 4A and 4B, the upper ends of rods 20 extend outward from the top of body 18 and the bottom end of rods 20 extend downward through but not out the bottom of body 18. From and through the outside face of body 18, adjacent the bottom end of each of rods 20, are thumb screws 28.

Additionally, as can best be seen in FIG. 4B, body 18 defines a channel 26 through which each of rods 20 are exposed. As will be made clear below, channel 26 is provided to permit the insertion of a jumper or fuse to selectively electrically interconnect a pair or two pair of rods 20 to each other.

Figure 6:
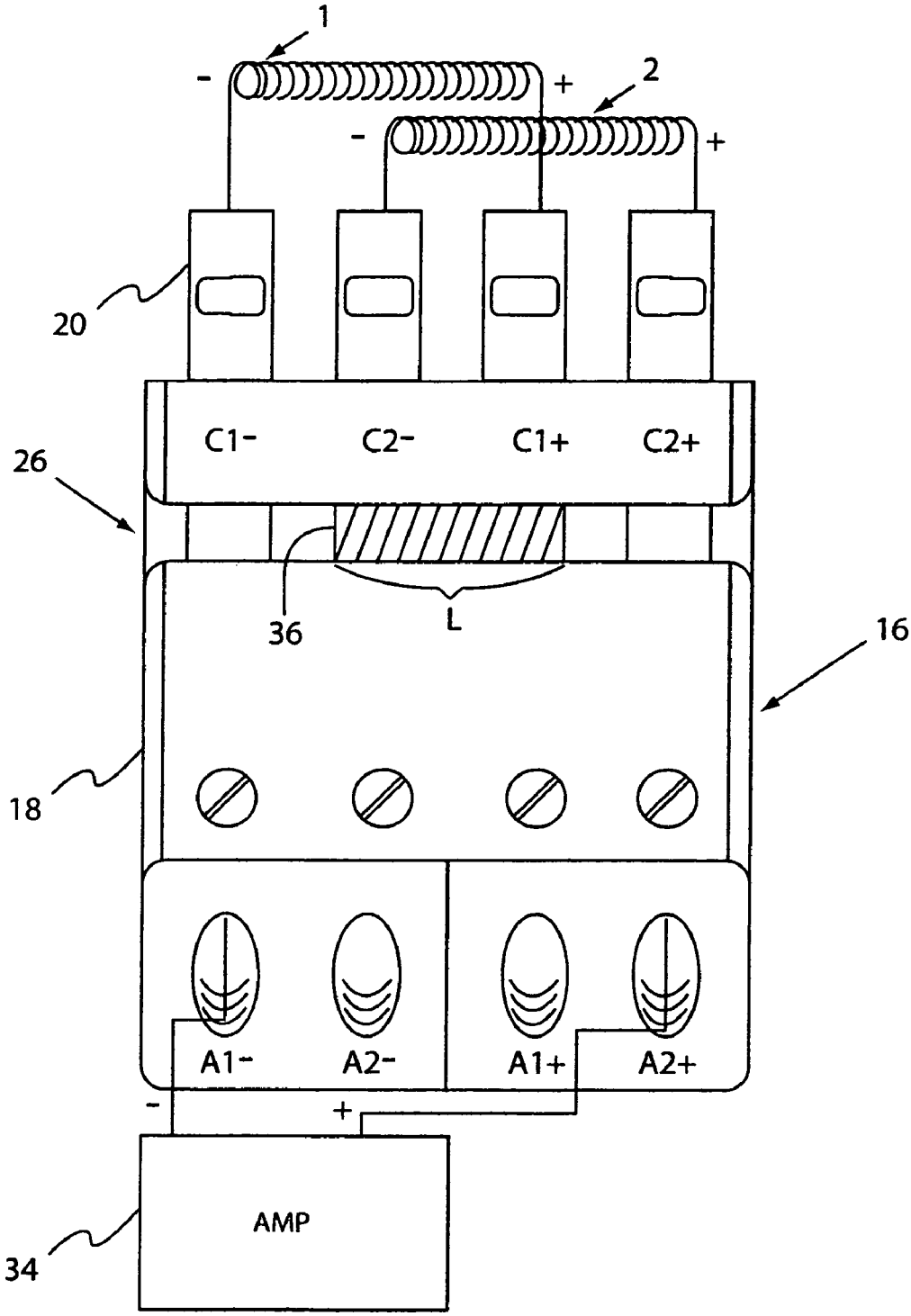
FIG. 6 is a plan view of the universal connection block of FIG. 4A having the two voice coil wire pairs connected thereto and being jumped to place them in series and connected to a single amplifier.
Figure 7:
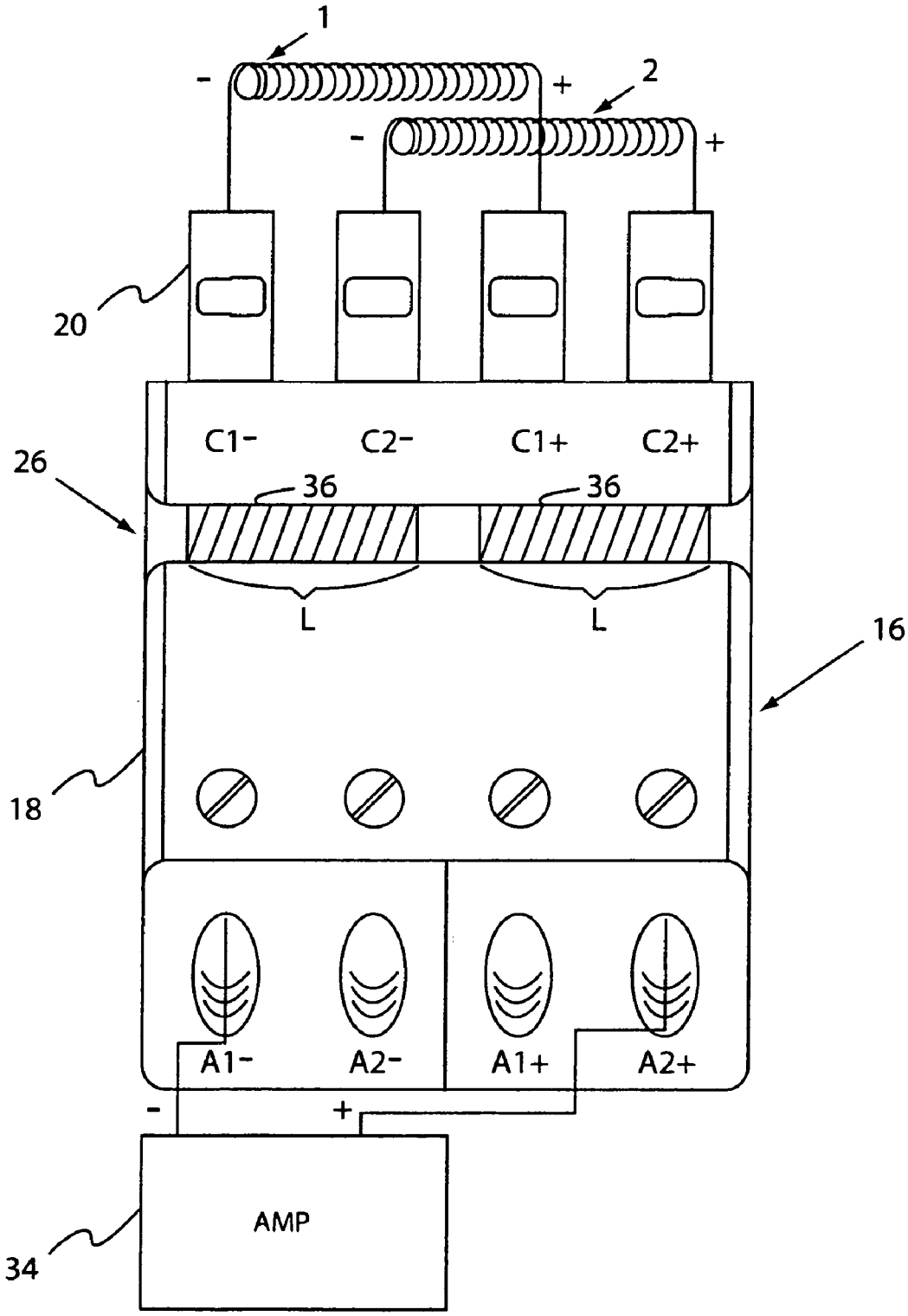
FIG. 7 is a plan view of the universal connection block of FIG. 4A having the two voice coil wire pairs connected thereto and being jumped to place them in parallel and connected to a single amplifier.

Note also that at the bottom of body 18, adjacent the four openings 22, 24 that extend to the bottom end of rods 20 there are, from left to right, the designations A1–, A2–, A1+ and A2+, in that order for the amplifier connection points. Additionally, adjacent the upper ends of rods 20 there are the designations, from left to right, C1–, C2–, C1+ and C2+, in that order for the voice coil connection points. The key that makes it possible to employ a universal speaker connection block of the present invention, as will be seen from the discussions of FIGS. 5–7, is the that the two negative voice coil terminals be next to each other and the two positive voice terminals be next to each other with the sequence alternating 1–, 2–, 1+, 2+; or 2–, 1–, 2+, 1+; or 1+, 2+, 1–, 2–; or 2+, 1+, 2–, 1–; from either the right or left side of the connection block.

Figure 5:
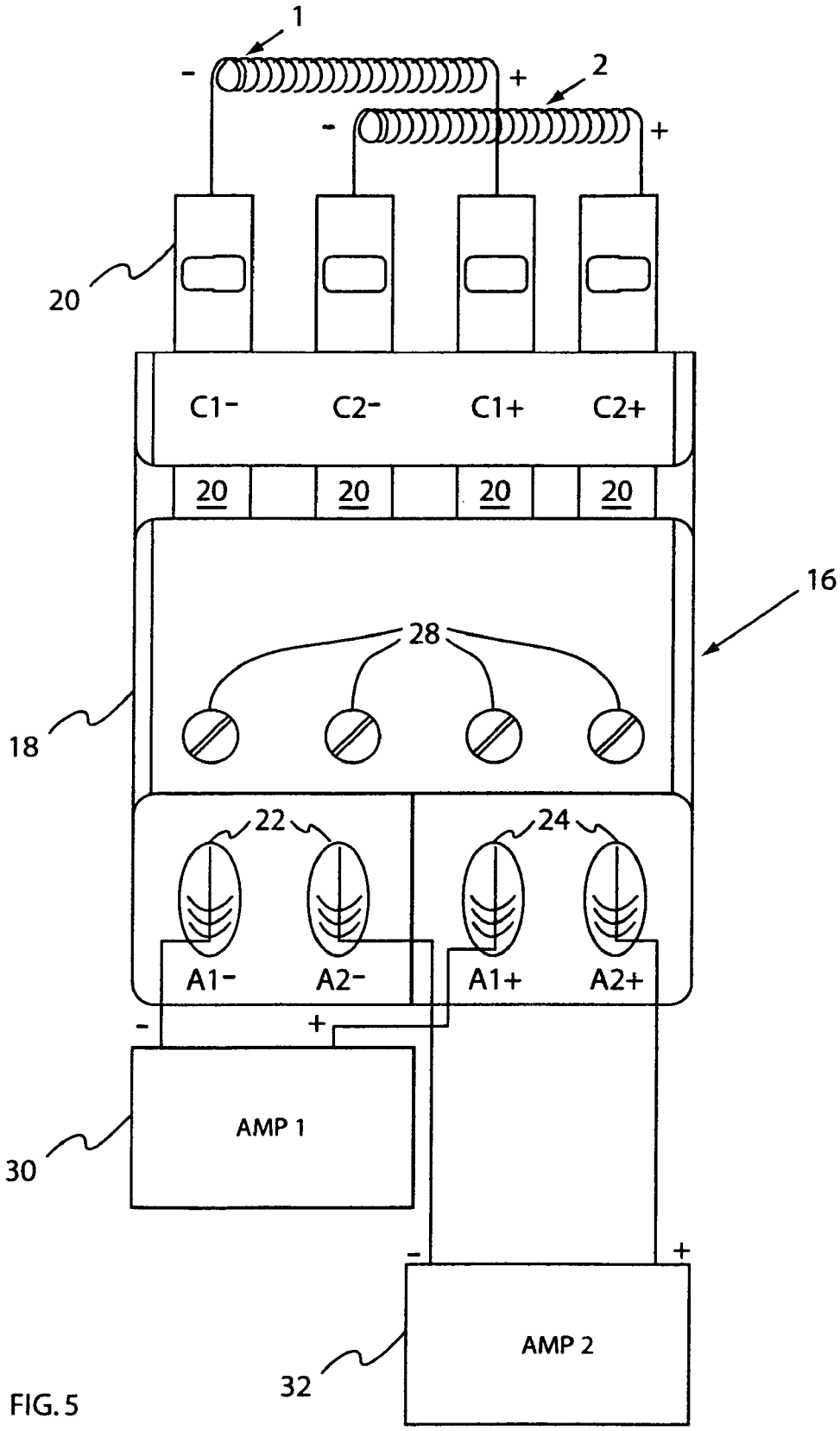
FIG. 5 is a plan view of the universal connection block of FIG. 4A having the two voice coil wire pairs and two amplifiers or amplifier channels connected thereto.

Referring next to FIG. 5 there is the plan view of the universal connection block 16 of FIG. 4A having two voice coils 1, 2 and two amplifiers 30, 32 (these can either be separate amplifiers or two channels of a multi-channel amplifier) connected thereto. At the top of connection block 18, from voice coil 1 the negative and positive leads are connected to rods 20 with the designations C1– and C1+, respectively, and from voice coil 2 the negative and positive leads are connected to rods 20 with the designations C2– and C2+, respectively. It is important to note that the two leads of either voice coil are not connected to immediately adjacent rods 20. The exact connection means, whether it be solder, thumb screws, etc., is a matter of design choice. However, in most instances the leads from the two voice coils will be attached to the connection block at the time of assembly of the speaker and therefore the leads will probably be soldered to rods 20 at that time.

At the bottom end of connection block 16, the amplifiers 30 and 32 have their positive and negative terminals connected to the terminals labeled A1– and A1+, and A2– and A2+, respectively. As shown here, the leads from the amplifiers are passed through the correspondingly labeled openings 22 and attached to rods 20 within body 18 by means of thumb screws 28. Alternatively, openings 22 could include therein a jack that is electrically connected to the corresponding rod 20 with each lead from the amplifiers including a plug to mate with the jack to make the connection of the amplifiers to the corresponding rod 20.

With amplifiers 30 and 32 connected as shown, amplifier 1 (30) is connected across voice coil 1 (A1– to C1– and A1+ to C1+) and amplifier 2 (32) is connected across voice coil 2 (A2– to C2– and A2+ to C2+).

FIG. 6 also includes a plan view of the universal connection block 16 of FIG. 4A having the two voice coils 1, 2 connected to rods 20 as they are in FIG. 5. The difference here is that there is a single amplifier 34 connected between terminals A1– and A2+ with an electrically conductive jumper 36 inserted in channel 26 to electrically interconnect the two center rods with the labels C2– and C1+. With jumper 36 inserted in this position it can be seen that voice coils 1 and 2 are connected in series electrically. The electrical path in this configuration is from the positive terminal of amplifier 34, terminal A2+, through the right most rod 20 to terminal C2+, through voice coil 2 to terminal C2– and the corresponding rod 20 to and through jumper 36 to rod 20 corresponding to terminal C1+, then through voice coil 1 to terminal C1–, through the corresponding rod 20 to terminal A1– and the negative terminal of amplifier 34.

Note rods 20 in connection block 16 are equally spaced from each other and that the length, L, of jumper 36 is no longer than the distance between non-adjacent sides of two adjacent rods 20 so that only two adjacent rods can be interconnected with a single jumper 36.

Next, FIG. 7 also includes a plan view of the universal connection block 16 of FIG. 4A having the two voice coils 1, 2 connected to rods 20 as they are in FIGS. 5 and 6. Also, as in FIG. 6, there is a single amplifier 34 connected between terminals A1– and A2+. The difference between FIGS. 6 and 7 is that in FIG. 7 there are two jumpers 36 inserted in channel 26, a first jumper 36 electrically interconnecting the two left most rods 20 and a second jumper 36 electrically interconnecting the two right most rods 20. Note that since rods 20 are equally spaced from each other, the same length jumpers 36 are used in both locations, and they are the same length as jumper 36 in FIG. 6.

With jumpers 36 inserted in the positions shown in FIG. 7 it can be seen that voice coils 1 and 2 are connected in parallel electrically. With amplifier 34 connected to the two outside rods 20, the first jumper 36 electrically interconnecting the two left most rods 20 to which the negative terminals of voice coils 1 and 2 are connected, respectively, connects the negative terminal of both voice coils to the negative terminal of amplifier 34; and similarly the second jumper 36 electrically interconnects the two right most rods 20 to which the positive terminals of voice coils 1 and 2 are connected, respectively, connects the positive terminal of both voice coils to the positive terminal of amplifier 34.

The advantage provided by the present invention is that it is possible with the equal spacing of the rods 20 in block 16, and more importantly, the connection sequence of the positive and negative terminals of the two voice coils (C1−, C2−, C1+, C2+; C2−, C1−, C2+, C1+; C2+, C1+, C2−, C1−; or C1+, C2+, C1−, C2−) and the a similar connection sequence of amplifier connections when two amplifiers are used, and with the outer most amplifier connections being used when there is only one amplifier in use without having to reconnect the voice coils to the connector block when different drive configurations are to be used. This combination of features makes it possible to use the same connection block 16 whether the two voice coils are each driven by a separate amplifier, when a single amplifier is being used to drive the series connected voice coils, or when a single amplifier is being used to drive the parallel connection of the voice coils as we have seen in FIGS. 5–7 without having to connect the voice coil leads to different terminals of the connection block for at least one of the possible configurations desired by users.

Figure 8:
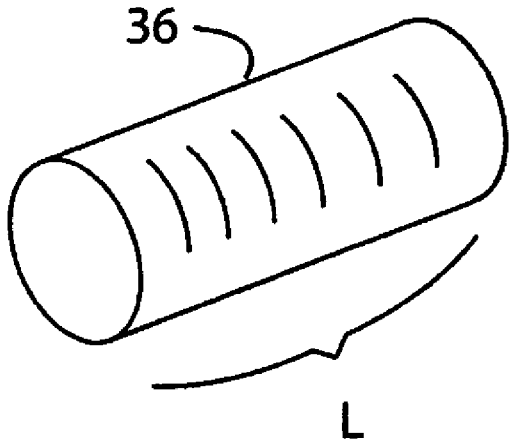
FIG. 8 is a perspective view of a jumper for use with the universal speaker connection block of FIGS. 4A and 4B.

FIG. 8 is a perspective view of a jumper 36 for use with the universal speaker connection block 16. The desired length of each jumper 36 has been discussed above and the end dimensions and shape of jumper 36 is selected to permit the insertion and retention of jumper 36 in channel 26 of connection block 16.

Figure 9:
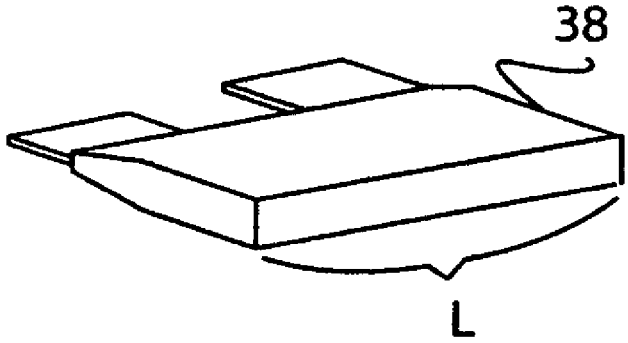
FIG. 9 is a perspective view of a fuse for use in place of the jumper of FIG. 8 with the universal speaker connection block.

Alternately, as shown in FIG. 9, a fuse 38 can be used in lieu of jumper 36 to interconnect the desired adjacent rods 20. If a fuse is used, channel 26 will include a receptacle attached to each rod 20 in channel 26 to receive and retain one end of fuse 38, and fuse 38 will also be of length L so that it is only possible for two adjacent rods 20 to be interconnected. The fusing capability of fuse 38 in lieu of jumper 36 provides an added degree of protection to prevent the overdriving of the voice coils, particularly when they are connected in series.

In summary the present invention provides a nearly fool proof speaker interconnection block that allows the user to drive a speaker with two voice coils with separate amplifiers, and to use one amplifier to drive the voice coils connected in either series when a higher speaker impedance is desired or in parallel when a lower speaker impedance is desired.

While only a single specific embodiment of the apparatus to carry out the present invention is disclosed, one skilled in the art could easily change the appearance of the physical device since the heart of the invention is the connection sequence and the ability to selectively interconnect the voice coils as desired in a nearly fool proof manner without having to change the physical connections of the voice coils to the universal connection block.

What is claimed is:

1. An audio speaker connection block for speakers having a first voice coil and a second voice coil, each voice coil having a first lead and a second lead, both voice coils to be driven by a single audio signal source or each voice coil to be driven by a different audio signal source, each audio signal source presenting an audio signal between two audio signal terminals, said connection block comprising:

first, second, third and fourth electrical conductors;

a housing to retain said first, second, third and fourth electrical conductors in fixed positions with respect to each other;

a voice coil terminal attached to each of said first, second, third and fourth electrical conductors, each voice coil terminal disposed to receive only one lead of one of said voice coils with said voice coil terminal attached to said first electrical conductor disposed to receive said first lead of said first voice coil of a first polarity, said voice coil terminal attached to said second electrical conductor disposed to receive said first lead of said second voice coil of said first polarity, said voice coil terminal attached to said third electrical conductor disposed to receive said second lead of said first voice coil of a second polarity, and said voice coil terminal attached to said fourth electrical conductor disposed to receive said second lead of said second voice coil of said second polarity; and an audio signal input terminal attached to each of said first, second, third and fourth electrical conductors, each disposed to have attached thereto no more than one different audio signal terminal.

2. The audio speaker connection block as in claim 1 wherein said second electrical conductor is spaced apart a selected distance from said first electrical conductor, said third electrical conductor is spaced apart said selected distance from said second electrical conductor, and said fourth electrical conductor is spaced apart said selected distance from said third electrical conductor.

3. The audio speaker connection block of claim 2:

wherein said housing defines a substantially linear opening there across exposing a portion of each of said first, second, third and fourth electrical conductors; and further comprising at least one electrically conductive jumper having a length that is only long enough to electrically interconnect two adjacent ones of said first, second, third and fourth electrical conductors when selectively inserted into said linear opening of said housing.

4. The audio speaker connection block of claim 3 wherein said at least one electrically conductive jumper is a fuse.

5. The audio speaker connection block as in claim 3 wherein a series connection of said first and second voice coils is to be driven by a single audio signal source, said audio signal input terminal of said first electrical conductor is disposed to have connected thereto an audio signal terminal of said first polarity of said single audio signal source, said audio signal input terminal of said fourth electrical conductor is disposed to have connected thereto an audio signal terminal of said second polarity of said single audio signal source, and a jumper inserted in said housing linear opening in electrical contact with said second and third electrical conductors to interconnect said first polarity lead of said second voice coil with said second polarity lead of said first voice coil.

6. The audio speaker connection block as in claim 3 wherein a parallel connection of said first and second voice coils is to be driven by a single audio signal source, said audio signal input terminal of said first electrical conductor is disposed to have connected thereto an audio signal terminal of said first polarity of said single audio signal source, said audio signal input terminal of said fourth electrical conductor is disposed to have connected thereto an audio signal terminal of said second polarity of said single audio signal source, a first jumper inserted in said housing linear opening in electrical contact with said first and second electrical conductors to interconnect said first polarity lead of each of said first and second voice coils, and a second jumper inserted in said housing linear opening in electrical contact with said third and fourth electrical conductors to interconnect said second polarity lead of each of said first and second voice coils.

7. The audio speaker connection block of claim 1 wherein said first, second, third and fourth electrical conductors are retained by said housing parallel to each other with a space between each adjacent electrical conductors.

8. The audio speaker connection block of claim 7 wherein said space between each pair of adjacent electrical conductors is substantially the same width.

9. The audio speaker connection block of claim 8 wherein said second electrical conductor is spaced apart from said first electrical conductor, said third electrical conductor is spaced apart from said second electrical conductor, and said fourth electrical conductor is spaced apart from said third electrical conductor.

10. The audio speaker connection block as in claim 1 wherein when each voice coil is to be driven by a different audio signal source, said audio signal input terminal of said first electrical conductor is disposed to have connected thereto an audio signal terminal of said first polarity of a first audio signal source, said audio signal input terminal of said second electrical conductor is disposed to have connected thereto an audio signal terminal of said first polarity of a second audio signal source, said audio signal input terminal of said third electrical conductor is disposed to have connected thereto an audio signal terminal of a second polarity of said first audio signal source, and said audio signal input terminal of said fourth electrical conductor is disposed to have connected thereto and audio signal terminal of said second polarity of said second audio signal source.

11. An audio speaker comprising:

a basket;

a cone;

an audio motor including a voice coil bobbin attached to said cone and having a first voice coil and a second voice coil would thereon, and each voice coil has a first lead and a second lead; and a speaker connection block mounted on said basket, said speaker connection block including:

first, second, third and fourth electrical conductors;

a housing to retain said first, second, third and fourth electrical conductors in fixed positions with respect to each other;

a voice coil terminal attached to each of said first, second, third and fourth electrical conductors, with each voice coil terminal having attached thereto only one lead of one of said voice coils with said first lead of said first voice coil attached to said voice coil terminal attached to said first electrical conductor, said first lead of said second voice coil attached to said voice coil terminal attached to said second electrical conductor, said second lead of said first voice coil attached to said voice coil terminal attached to said third electrical conductor, and said second lead of said second voice coil attached to said voice coil terminal attached to said fourth electrical conductor; and an audio signal input terminal attached to each of said first, second, third and fourth electrical conductors, each disposed to have attached thereto a different audio signal terminal.

12. The audio speaker as in claim 11 wherein said second electrical conductor is spaced apart a selected distance from said first electrical conductor, said third electrical conductor is spaced apart said selected distance from said second electrical conductor, and said fourth electrical conductor is spaced apart said selected distance from said third electrical conductor.

13. The audio speaker of claim 12:

wherein said housing defines a substantially linear opening there across exposing a portion of each of said first, second, third and fourth electrical conductors; and further comprising at least one electrically conductive jumper having a length that is only long enough to electrically interconnect two adjacent ones of said first, second, third and fourth electrical conductors when selectively inserted into said linear opening of said housing.

14. The audio speaker of claim 13 wherein said at least one electrically conductive jumper is a fuse.

15. The audio speaker connection block as in claim 13 wherein a series connection of said first and second voice coils is to be driven by a single audio signal source, said audio signal input terminal of said first electrical conductor is disposed to have connected thereto an audio signal terminal of said first polarity of said single audio signal source, said audio signal input terminal of said fourth electrical conductor is disposed to have connected thereto an audio signal terminal of said second polarity of said single audio signal source, and a jumper inserted in said housing linear opening in electrical contact with said second and third electrical conductors to interconnect said first polarity lead of said second voice coil with said second polarity lead of said first voice coil.

16. The audio speaker connection block as in claim 13 wherein a parallel connection of said first and second voice coils is to be driven by a single audio signal source, said audio signal input terminal of said first electrical conductor is disposed to have connected thereto an audio signal terminal of said first polarity of said single audio signal source, said audio signal input terminal of said fourth electrical conductor is disposed to have connected thereto an audio signal terminal of said second polarity of said single audio signal source, a first jumper inserted in said housing linear opening in electrical contact with said first and second electrical conductors to interconnect said first polarity lead of each of said first and second voice coils, and a second jumper inserted in said housing linear opening in electrical contact with said third and fourth electrical conductors to interconnect said second polarity lead of each of said first and second voice coils.

17. The audio speaker of claim 11 wherein said first, second, third and fourth electrical conductors are retained by said housing parallel to each other with a space between each adjacent electrical conductors.

18. The audio speaker of claim 17 wherein said space between each pair of adjacent electrical conductors is substantially the same width.

19. The audio speaker of claim 18 wherein said second electrical conductor is spaced apart from said first electrical conductor, said third electrical conductor is spaced apart from said second electrical conductor, and said fourth electrical conductor is spaced apart from said third electrical conductor.

20. The audio speaker connection block as in claim 11 wherein when each voice coil is to be driven by a different audio signal source, said audio signal input terminal of said first electrical conductor is disposed to have connected thereto an audio signal terminal of said first polarity of a first audio signal source, said audio signal input terminal of said second electrical conductor is disposed to have connected thereto an audio signal terminal of said first polarity of a second audio signal source, said audio signal input terminal of said third electrical conductor is disposed to have connected thereto an audio signal terminal of a second polarity of said first audio signal source, and said audio signal input terminal of said fourth electrical conductor is disposed to have connected thereto an audio signal terminal of said second polarity of said second audio signal source.

21. A method for interconnecting first and second voice coils wound on a voice coil bobbin of an audio speaker, said first and second coils to be driven by a single audio signal source or each of said first and second voice coils to be driven by a different audio signal source, each voice coil having a first lead and a second lead, each audio signal source presenting an audio signal between two audio signal terminals, said method comprising the steps of:

a. mounting first, second, third and fourth electrical conductors on said audio speaker;

b. retaining said first, second, third and fourth electrical conductors in fixed positions with respect to each other;

c. attaching said first lead of said first voice coil to said first electrical conductor, said first lead of said second voice coil to said second electrical conductor, said second lead of said first voice coil to said third electrical conductor, and said second lead of said second voice coil to said fourth electrical conductor; and d. disposing each of said first, second, third and fourth electrical conductors to have attached thereto a different audio signal terminal.

22. The method of claim 21 wherein step b. includes the step of:

e. spacing said second electrical conductor apart a selected distance from said first electrical conductor, said third electrical conductor apart said selected distance from said second electrical conductor, and said fourth electrical conductor apart said selected distance from said third electrical conductor.

23. The method of claim 22:

wherein step b. retains said first, second, third and fourth electrical conductors in a housing affixed to said audio speaker;

said method further includes the step of:

f. defining a substantially linear opening across said housing exposing a portion of each of said first, second, third and fourth electrical conductors.

24. The method of claim 23 further comprising the step of:

g. inserting an electrically conductive jumper into said substantially linear opening to electrically interconnect two adjacent ones of said first, second, third and fourth electrical conductors.

25. The method of claim 24 wherein said electrically conductive jumper is a fuse.

26. The method of 24:

the method further includes the step of:

h. connecting an audio signal terminal of said first polarity of said single audio signal source to said first electrical conductor, and an audio signal terminal of said second polarity of said single audio signal source to said fourth electrical conductor; and wherein the jumper of step g. is inserted in electrical contact with said second and third electrical conductors to interconnect said first polarity lead of said second voice coil with said second polarity lead of said first voice coil thus providing a series connection of said first and second voice coils to be driven by said single audio signal source.

27. The method of claim 23 further includes the steps of:

g. inserting a first electrically conductive jumper into said substantially linear opening to electrically interconnect said first and second electrical conductors;

h. inserting a second electrically conductive jumper into said substantially linear opening to electrically interconnect said third and fourth electrical conductors; and i. connecting an audio signal terminal of said first polarity of said single audio signal source to said first electrical conductor, and an audio signal terminal of said second polarity of said single audio signal source to said fourth electrical conductor;

wherein said first and second voice coils are connected in parallel and driven by a single audio signal source.

28. The method of claim 21 wherein step b. includes the step of:

e. retaining said first, second, third and fourth electrical conductors parallel to each other with a space between each adjacent electrical conductors.

29. The method of claim 28 wherein said space between each pair of adjacent electrical conductors is substantially the same width.

30. The method of claim 29 wherein said second electrical conductor is spaced apart from said first electrical conductor, said third electrical conductor is spaced apart from said second electrical conductor, and said fourth electrical conductor is spaced apart from said third electrical conductor.

31. The method of claim 21 further including the step of:

e. connecting an audio signal terminal of said first polarity of a first audio signal source to said electrical conductor, an audio signal terminal of said first polarity of a second audio signal source to said second electrical conductor, an audio signal terminal of a second polarity of said first audio signal source to said third electrical conductor, and an audio signal terminal of said second polarity of said second audio signal source to said fourth electrical conductor to interconnect said first voice coil to said first audio signal source and sand second voice coil to said second audio source.

* * * * *